US005255821A

United States Patent [19]

Hall et al.

[11] Patent Number: 5,255,821

[45] Date of Patent: Oct. 26, 1993

[54] TRANSPORTABLE ENVIRONMENTALLY SAFE CHEMICAL DISPENSE MODULE

[75] Inventors: James C. Hall, San Jose, Calif.; Jon P. Goodbread, Thornton, Colo.; Kenneth M. O'Connor, Fremont, Calif.

[73] Assignee: Systems Chemistry, Inc., Milpitas, Calif.

[21] Appl. No.: 988,550

[22] Filed: Dec. 10, 1992

[51] Int. Cl.[5] ..... B67D 5/32

[52] U.S. Cl. ..... 222/39; 137/377; 222/77; 222/135; 222/183; 222/189

[58] Field of Search ..... 222/39, 54, 77, 129, 222/135, 183, 189; 137/377; 52/79.1; 312/1

[56] References Cited

U.S. PATENT DOCUMENTS 4,182,047 3/1989 Baumann ..... 222/77 X
4,715,721 12/1987 Walker et al. ..... 222/135 X
4,850,380 7/1989 Koslow ..... 312/1 X

*Primary Examiner*—Andres Kashnikow
*Assistant Examiner*—Joseph A. Kaufman
*Attorney, Agent, or Firm*—Claude A. S. Hamrick

[57] ABSTRACT

A transportable environmentally safe chemical dispense module including a rigid structure forming an environmentally secure work chamber having at least two passageways for human ingress and egress, a containment chamber formed at the bottom thereof beneath a liquid-permeable floor, a container for supply chemicals, a dispensing unit and associated piping for withdrawing chemical from the supply container, passing it through a filtration systems and into a holding container, and dispensing it to a piping interface in a wall of the enclosure. Internal electrical wiring and associated monitoring and control apparatus are likewise connected to a service interface formed in a wall of the enclosure. Other features such as air purifiers, alarm systems, emergency showers, and eye wash sprays for accommodating the safety of both worker and environment are also included.

10 Claims, 2 Drawing Sheets

TRANSPORTABLE ENVIRONMENTALLY SAFE CHEMICAL DISPENSE MODULE

BACKGROUND OF THE INVENTION

1. Field of the Invention

The present invention relates generally to hazardous fluids processing apparatus and more particularly to a self-contained environmentally secure container module and associated chemical processing and dispensing system which is transportable and meets all environmental quality control criteria.

2. Description of the Prior Art

In many manufacturing industries various corrosive, caustic, combustible and flammable chemicals and other gases and liquids are used and must be carefully handled to prevent damage to mechanical equipment and/or injury to both the environment and operating personnel. Handling or transport of such materials can be manual or by use of sophisticated distribution systems. In most instances, protection of the environment and/or personnel is regulated through the enforcement of federal, state and local codes. Compliance with such codes is normally enforced by building, fire and safety permitting and inspection processes. Compliance is therefore assured on new structures by regulation of the permitting process. However, many existing structures have difficulty in meeting or complying with modern codes due to plant design, available space, or prohibitive cost restraints. Although certain structures may be given exemptions due to grandfather clauses and the like, it is apparent that cost effective means must be provided to facilitate the distribution of hazardous materials in both new and older facilities while providing safety for the environment and personnel, and at the same time complying with regulatory codes.

SUMMARY OF THE INVENTION

It is therefore a principal objective of the present invention to incorporate a complete state-of-the-art hazardous material distribution system in an enclosed preassembled module that is constructed to meet all regulatory codes, is mobile, and can be positioned internal or external of a factory building.

Another objective of the present invention is to provide a device of the type described which meets all building code and permit requirements, thereby substantially reducing the construction/insulation costs and time required to implement the system.

Another objective of the present invention is to provide a chemical distribution system which delivers or recovers aqueous chemicals using pumping or pressurized means and which improves chemical quality by filtration, distillation or purification.

A further objective of the present invention is to provide a module of the type described that is fully equipped with safety features such as heat sensors, fire sprinklers, exhaust system, shower and eye wash facilities, and leak detection systems.

A still further objective of the present invention is to provide a module of the type described having a fully contained chemical distribution system, double containment piping system, and means of communication to monitor the system events within the module and periodically report to a data supervisor and then to a central computer system.

Another object of the invention is to provide a module of the type described that is certified to meet Class 1 Division 1 Codes for handling flammable liquids by incorporating explosion-proof circuits and blow-out panels.

Briefly, a preferred embodiment of the present invention includes a rigid structure forming an environmentally secure work chamber having at least two passageways for human ingress and egress, a containment chamber formed at the bottom thereof beneath a liquid-permeable floor, a container for supply chemicals, a dispensing unit and associated piping for withdrawing chemical from the supply container, passing it through a filtration systems and into a holding container, and dispensing it to a piping interface in a wall of the enclosure. Internal electrical wiring and associated monitoring and control apparatus are likewise connected to a service interface formed in a wall of the enclosure. Other means such as air purifiers, alarm systems, emergency showers, and eye wash sprays for accommodating the safety of both worker and environment are also included.

An important advantage of the present invention is that it provides a self-contained means for allowing hazardous material handling and distribution in existing facilities that do not have the space available and cannot comply with current building codes.

Another advantage of the present invention is that the present invention includes a communications system which allows all operational components, chemical status, quantities, and safety parameters to be monitored from a remote location.

Still another advantage of the present invention is that the module is equipped with a leak detection system which will, in the event of a component failure, automatically shut down and provide containment, environmental safety, and a means for transmitting an alert signal.

Yet another advantage of the present invention is that it provides an entirely self-contained module which is fully mobile and can be installed either inside or outside of a building.

These and other objects and advantages of the present invention will no doubt become apparent to those skilled in the art after having read the following detailed description which makes reference to the several figures of the drawing.

IN THE DRAWING

DETAILED DESCRIPTION OF THE PREFERRED EMBODIMENT

Figure 1:
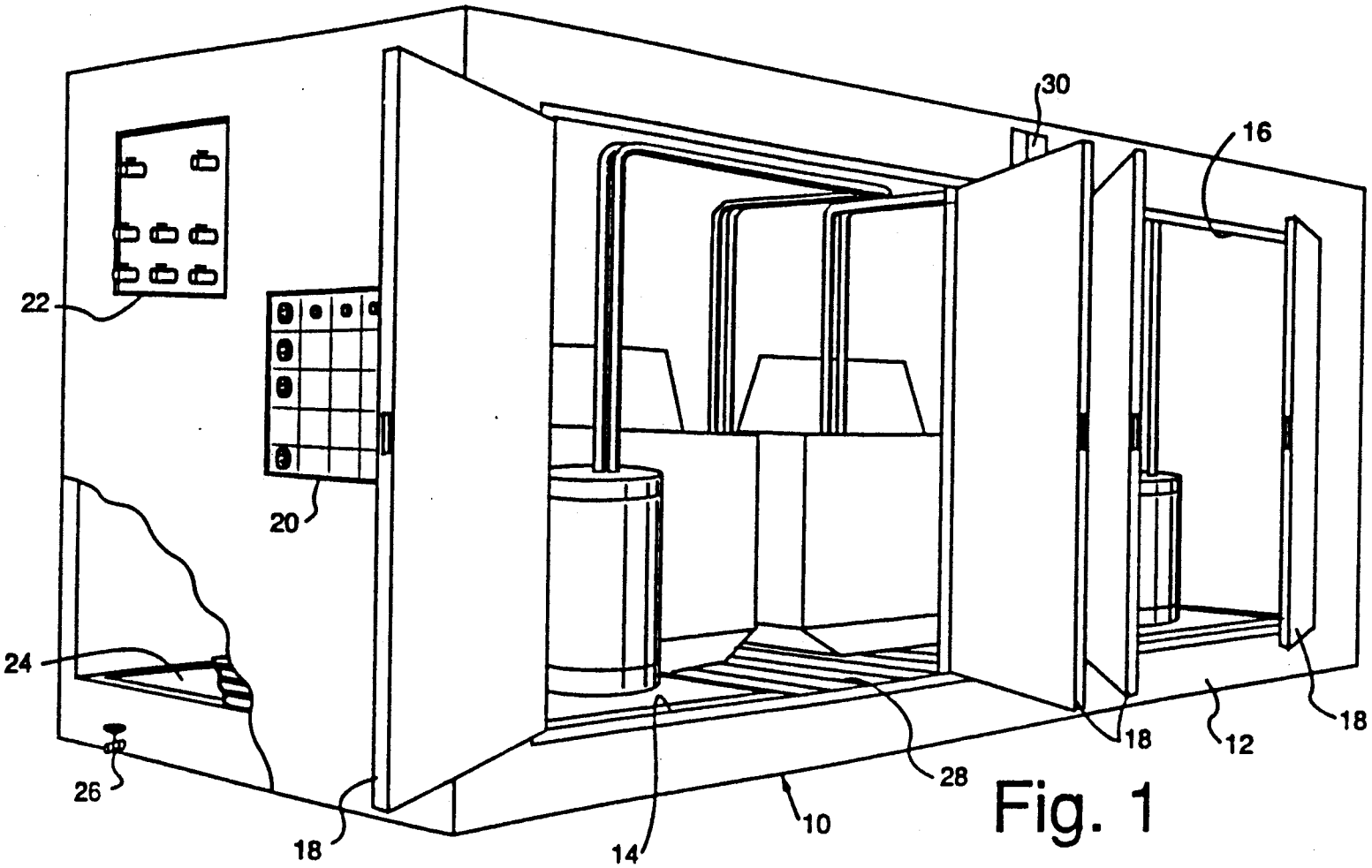
FIG. 1 is a perspective view illustrating a chemical dispense module in accordance with the present invention.

Referring now to FIG. 1 of the drawing, there is shown at 10 a chemical dispense module in accordance with the present invention. As illustrated, module 10 includes means forming a sturdy outer housing 12 made of reinforced plastic, stainless steel, reinforced fiberglass, or other suitable material. Housing 12 forms an interior work chamber and is provided with at least two openings 14 and 16 which are closable by lockable closures or doors 18. At appropriate locations in at least one wall of the housing 12 are appropriate panels 20 providing groupings of connectors for interfacing electrical power and communications lines, and a facilities panel 22 for coupling input and output fluid lines including sprinkler water, shower water, DI water, nitrogen, and other process fluids. Although shown in FIG. 1 as located on a common end wall of housing 12, it will be understood that panels 20 and 22 could be located on any wall and could even be divided into separate subpanels and distributed around the unit.

The bottom of housing 12 is configured as depicted in broken-away detail at 24 to form a containment chamber for containing any fluids that might leak within the housing. A sump drain for the module is provided at 26. Containment chamber 24 is covered by a slatted or apertured wood, metal or composite floor 28 which forms a passageway from the working space within the interior of the module and into the chamber 24 for any fluids spilled or leaked within the module. In a preferred embodiment an alarm system monitor is also provided at 30.

Figure 2:
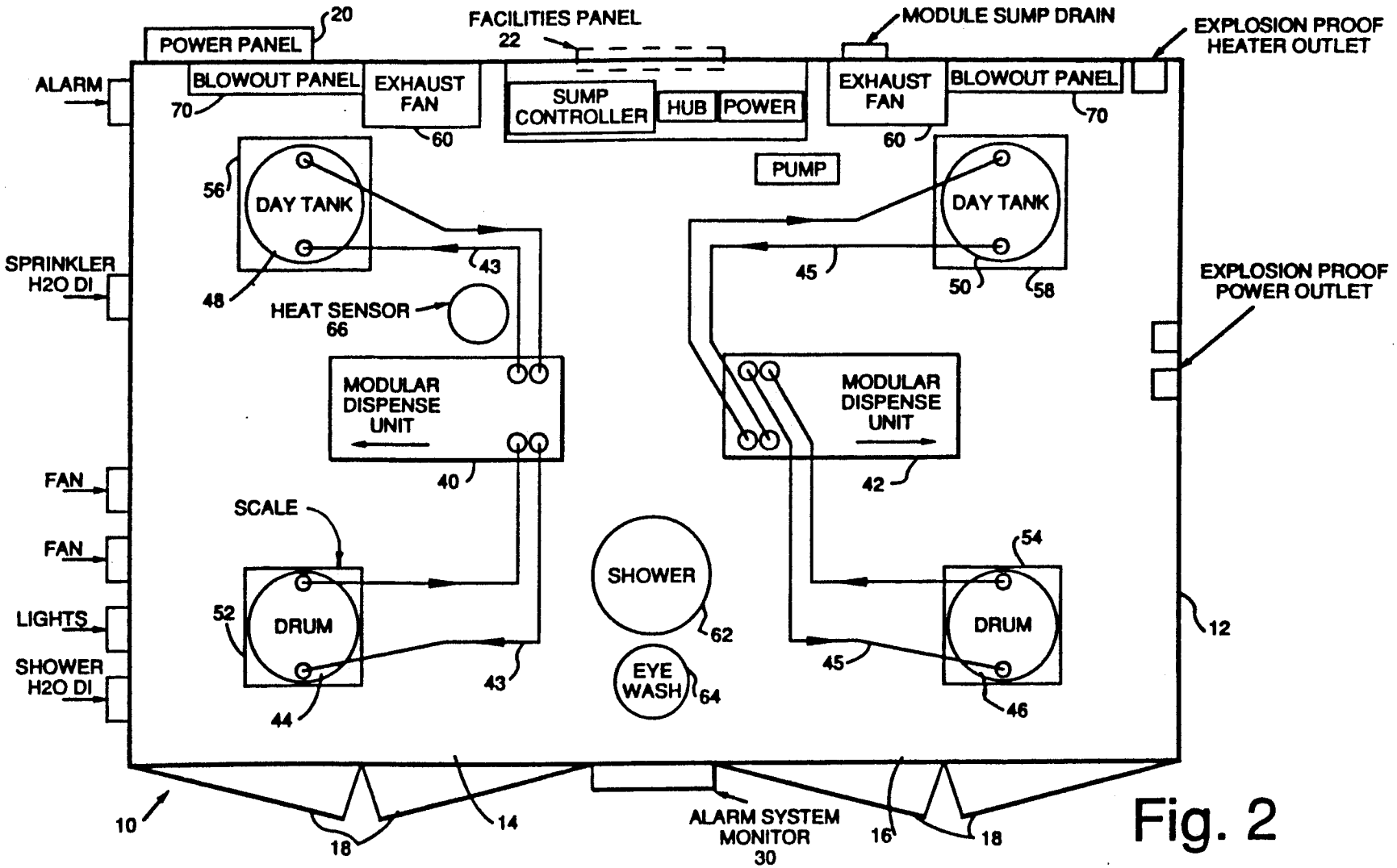
FIG. 2 is a top plan view schematically illustrating a preferred layout of the operative components in a chemical dispense module in accordance with the present invention.

Turning now additionally to FIG. 2 of the drawing, a typical arrangement of interior functional components is illustrated in schematic detail. As depicted, two independent modular dispense units 40 and 42 are disposed in a central location within housing 12 and are connected via suitable plumbing 43 and 45 to supply drums 44 and 46, respectively, and permanent, stationary vessels or day tanks 48 and 50. Units 40 and 42 typically include suitable pumps, filters and flow measurement and control sensors and electronics. Note that each of the tanks 44–50 is supported by a scale 52–58 which is electrically connected to and reports to either an onboard control system (not shown) or a remote control system coupled through the facility's panel 20.

Also disposed within the interior of housing 12 is one or more exhaust systems 60, an emergency shower 62, and an emergency eye wash station 64. In addition, a heat sensor 66 may be provided which is coupled to the alarm system and controller for generating an alarm in the event of a system malfunction, and for even shutting down the system if appropriate. The exhaust 60 and heat sensor 66 may also be associated with a chamber cooling and/or air quality control system. Blow-out panels 70 may also be included and all interior power outlets are explosion-proof.

In accordance with the present invention, a processing plant requiring additional fluid dispensing capability would have a device of the type illustrated at 10 assembled to include those internal compounds needed to meet their requirements, and such apparatus would be shipped to their facility. It would then be suitably located either inside or outside of a plant building and Would be appropriately plumbed, powered, and connected to communications apparatus.

In one embodiment, such as that illustrated in FIG. 2, the drums 44 and 46 would be removable drums which would normally serve as chemical supply reservoirs containing chemicals that are to be filtered and perhaps even mixed with other chemicals and then temporarily stored in day tanks 48 and 50 under the control of the dispense units 40 and 42. The processed chemicals would then be output through the facilities panel 22.

It will be appreciated that since the module 10 is designed to comply with all modern environmental, safety and building codes, it will not require special installation or construction permits other than those relating to electrical and plumbing connections As a consequence, great savings and efficiency in facility's costs can be achieved.

Although the present invention has been described in terms of a single preferred embodiment which is illustrated in the drawings, it will be appreciated that numerous configurations of both the module housing and its internal functional components can be assembled and numerous alterations and modifications made. It is therefore intended that the appended claims include all such alterations, modifications and combinations as fall within the true spirit and scope of the invention.

What is claimed is:

1. A transportable chemical dispense module comprising:

means forming a rugged structural housing defining an interior work chamber having at least two separate closable openings for ingress and egress and means forming a containment chamber at the bottom of the housing covered by a perforated floor;

chemical supply reservoir means disposed within said work chamber;

chemical dispense means disposed within said work chamber and communicatively coupled to said supply reservoir means for dispensing chemicals contained in the reservoir means to an external user via internal plumbing and a plumbing interface formed in a wall of said module;

means for monitoring the amount of chemicals contained in said supply reservoir means and the amount dispensed therefrom; and means for controlling the operation of said dispense means.

2. A transportable chemical dispense module as recited in claim and further comprising holding tank means disposed within said work chamber and connected to said dispense means for temporarily holding chemicals removed from said reservoir means.

3. A transportable chemical dispense module as recited in claim 1 and further comprising filter means associated with said dispense means for filtering chemicals removed from said reservoir means by said dispense means.

4. A transportable chemical dispense module as recited in claim 1 wherein said means for monitoring further includes means responsive to the operation particular functional components disposed within said work chamber and operative to generate an alarm signal in the event of a malfunction.

5. A transportable chemical dispense module as recited in claim 4 and further comprising communications interface means formed in a wall of said housing and coupled to said means for monitoring and said means for controlling, said communications interface means including connectors to which external communications cables may be connected to communicatively couple external control and monitoring apparatus to said module.

6. A transportable chemical dispense module as recited in claim 2 and further comprising filter means associated with said dispense means for filtering chemicals removed from said reservoir means by said dispense means.

7. A transportable chemical dispense module as recited in claim 1 and further comprising means for controlling the temperature and air quality within said work chamber.

8. A transportable chemical dispense module as recited in claim 1 wherein said housing is provided with explosion proof power outlets and blowout panels.

9. A transportable chemical dispense module as recited in claim 1 and further comprising emergency shower and eye wash apparatus disposed within said work chamber.

10. A transportable chemical dispense module as recited in claim 2 wherein said reservoir means, holding tank means and dispense means each includes a plurality of individual units all selectively interconnectable by means of a network of flow-carrying tubes and valves.

* * * * *